US006499681B1

(12) United States Patent
Maruyama

(10) Patent No.: US 6,499,681 B1
(45) Date of Patent: Dec. 31, 2002

(54) CRUSHING DEVICE IN A CRUSHER OF AN EARTHMOVER FOR CRUSHING CHUNKS OF CONCRETE INTO FINE PIECES

(76) Inventor: Mitsuru Maruyama, 19-2, 5-Chome Takashimadaira, Itabashi-Ku, Tokyo (JP)

( * ) Notice: Subject to any disclaimer, the term of this patent is extended or adjusted under 35 U.S.C. 154(b) by 187 days.

(21) Appl. No.: 09/704,748

(22) Filed: Nov. 3, 2000

(30) Foreign Application Priority Data

Jun. 21, 2000 (JP) ..... 2000-186325

(51) Int. Cl.[7] ..... B02C 2/00

(52) U.S. Cl. ..... 241/74; 241/101.72; 241/101.742; 241/260.1

(58) Field of Search ..... 241/101.72, 101.74, 241/260.1, 101.742, 257.1, 69, 73, 74

(56) References Cited

U.S. PATENT DOCUMENTS 4,440,352 A * 4/1984 Rossler ..... 241/152.2
4,593,861 A * 6/1986 Blakley et al. ..... 241/246
4,610,397 A * 9/1986 Fischer et al. ..... 241/199.12
5,405,092 A * 4/1995 Jonninen ..... 241/101.72
5,887,810 A * 3/1999 Maruyama ..... 241/189.1
6,237,865 B1 * 5/2001 Luttermann et al. ... 241/101.72

* cited by examiner

*Primary Examiner*—John M. Husar
(74) *Attorney, Agent, or Firm*—Jacobson Holman PLLC

(57) ABSTRACT

A crushing device in a crusher includes a bucket-shaped body frame; plural ring members provided in the body frame in such a manner as to form steps at predetermined spaced intervals while diminishing their sizes gradually from the upper position toward the lower position, thereby to form a sieve with gaps as a whole; a teeth plate provided at the bottom portion of the sieve and having recessed teeth and protrusive teeth alternately formed on the inner surface thereof; a crushing shaft provided at a central portion of the body frame; and an inclined screw belt member mounted on the crushing shaft, for crushing pieces of concrete on the teeth plate in combination with the teeth plate.

8 Claims, 3 Drawing Sheets

CRUSHING DEVICE IN A CRUSHER OF AN EARTHMOVER FOR CRUSHING CHUNKS OF CONCRETE INTO FINE PIECES

BACKGROUND OF THE INVENTION

The present invention relates to a chunks-of-concrete crushing device which also serves as a scooping device such as a bucket, a shovel or the like mounted on the distal end of a rotatable arm of an earthmover. Particularly, the present invention relates to a crushing device capable of crushing chunks of concrete into very fine pieces.

According to conventional crushing devices of this kind, chunks of concrete are crushed into equalized pieces in size, and thus, the efficiency of scattering pieces of crushed concrete is limited low. That means that in the conventional crushing devices, there are many cases where pieces of crushed concrete can not be scattered over to distant points as desired, and it is not possible to obtain pieces of various sizes.

SUMMARY OF THE INVENTION

It is an object of the present invention to improve the efficiency of scattering pieces of crushed concrete, and to enable obtaining easily as much fine pieces of crushed concrete as desired under particular operative circumstances.

The crushing device according to the present invention comprises: a bucket-shaped body frame; plural ring members provided in said body frame in such a manner as to form steps at predetermined spaced intervals while diminishing their sizes gradually from the upper position toward the lower position, thereby to form a sieve with gaps as a whole; a teeth plate provided at the bottom portion of said sieve and having recessed teeth and protrusive teeth alternately formed on the inner surface thereof; a crushing shaft provided at a central portion of said body frame; and an inclined screw belt member mounted on said crushing shaft, for crushing pieces of objects on said teeth plate in combination with said teeth plate.

BRIEF DESCRIPTION OF THE DRAWINGS

The accompanying drawings show an embodiment of a crushing device in a crusher for crushing objects into fine pieces, according to the present invention.

BEST MODE FOR CARRYING OUT THE INVENTION

Figure 1:
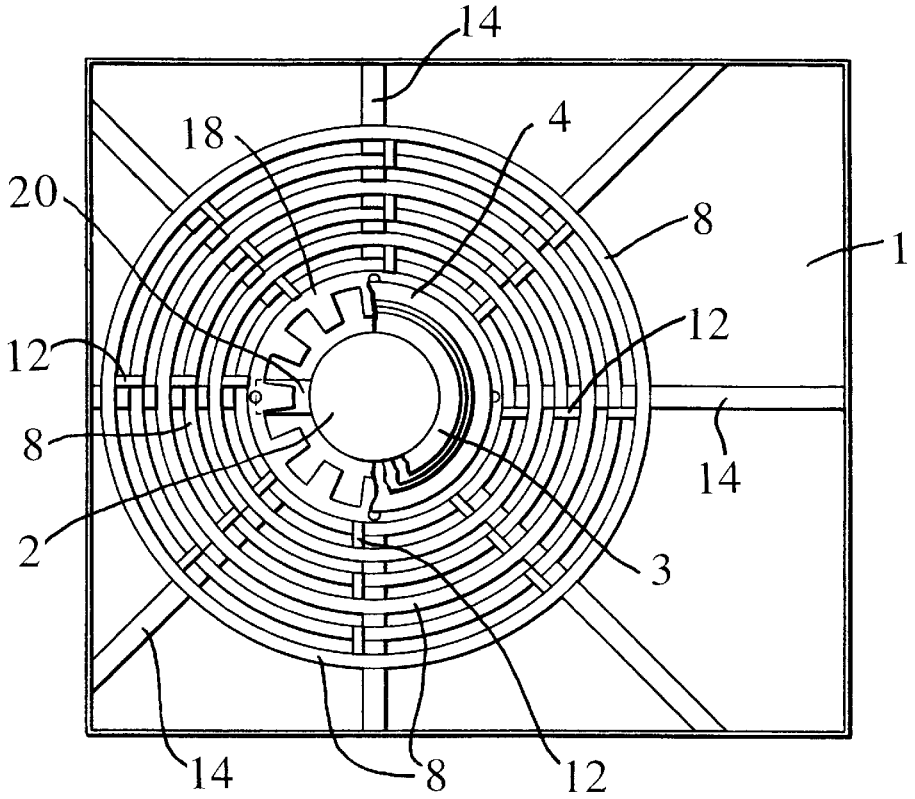
FIG. 1 shows a plan view thereof.
Figure 2:
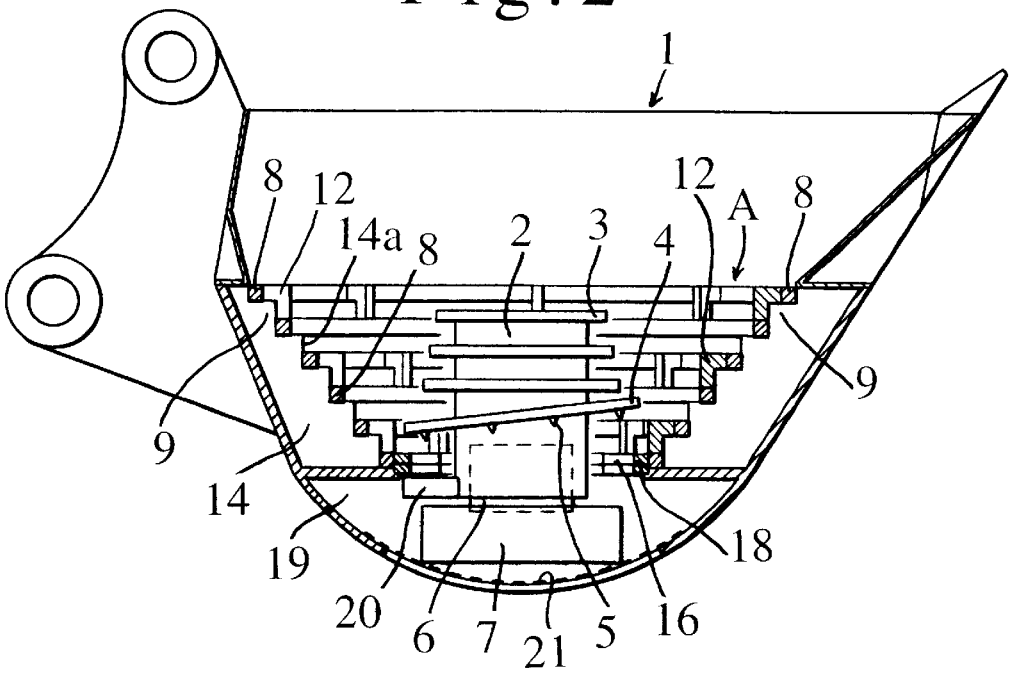
FIG. 2 shows a longitudinally cross-sectional view thereof.
Figure 3:
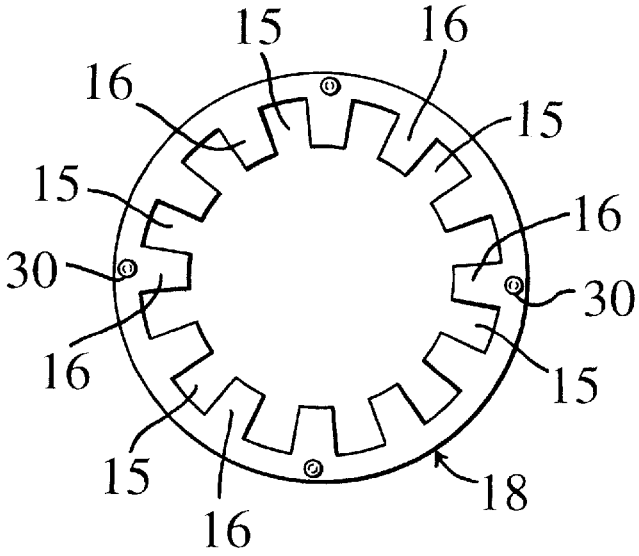
FIG. 3 shows a plan view of a teeth plate in the present invention.

In FIGS. 1 and 2, reference numeral 1 denotes a bucket-shaped body frame, and reference numeral 2 denotes a crushing shaft provided at a central portion of the inside of said body frame 1. On the outer periphery of said crushing shaft 2 are provided plural crushing teeth 3. At a lower portion of said crushing shaft 2 is fixed an inclined spiral screw belt 4 whose lower surface has plural projections 5 provided thereon. In this connection, the accompanying Figures show an embodiment, with only one inclined spiral screw belt shown. However, it is also possible to employ plural inclined spiral screw belts in the present invention.

The crushing shaft 2, which is rotated by an oil-hydraulic motor, is fixed to the frame 1 via a motor rest 7.

Inside of the body frame 1, plural ring members 8 are provided in such a manner that the ring members 8 fit with step portions 14*a* of radially-provided ridges 14, with gaps 9 each provided between adjacent ring members 8, and diminish their sizes from the upper position toward the lower position, thereby constituting a sieve A with gaps. On the inner side of each of the ring members 8 are provided plural fixed teeth 12. The bottom portion of the body frame 1 is left open as a space 19 through which pieces of crushed concrete are allowed to fall.

A reinforcing bar cutting member 20 is protrusively provided on a crushing shaft 2 in such a manner that said reinforcing bar cutting member 20 is located between the motor rest 7 and a teeth plate 18.

The reinforcing bar cutting member 20 not only functions as a reinforcing bar cutter for cutting reinforcing bars (mixed with concrete) which have fallen below the teeth plate 18, but also serves a function of hitting and removing pieces of crushed concrete which have accumulated on the motor rest 7 during crushing operation. In the drawings, the ring members 8 are of square cross section. Here, it is also possible to employ plate-type ring members or adopt ring members of round cross section.

In the practical crushing operation, large chunks of concrete scooped into the body frame 1 are crushed by both the crushing teeth 3 provided on the crushing shaft 2 and the fixed teeth 12 acting from the body frame side. Pieces of crushed concrete smaller than the gaps each provided between adjacent ring members 8, 8 go it through, pass through spaces each provided between adjacent radially-provided ridges 14, reach a bottom space of the body frame 1, and eventually fall off from the bottom space. Pieces of crushed concrete larger than the gaps each provided between adjacent ring members 8, 8 are further crushed by the crushing teeth 3 and the fixed teeth 12. Some of the further crushed pieces go through the gaps each provided between adjacent ring members 8, 8, and others get into a space between the teeth plate 18 and an inclined screw belt member 4 provided at a lower portion of the crushing shaft 2. The latter is forced to get into a space provided at the inner periphery of the teeth plate 18 so as to be crushed compressively, because there is little space left below the rear-end part of the screw belt member 4 with respect to the rotational direction thereof. The compressively crushed pieces are eventually discharged through the bottom space of the body frame.

In this way, the combination of the screw belt member 4 and the teeth plate 18 serves not only the pressing-in and pressing-out functions but also the crushing function. Protuberances provided at the lower surface of the screw belt member 4 help to enhance the efficiency of the crushing operation greatly.

Figure 4:
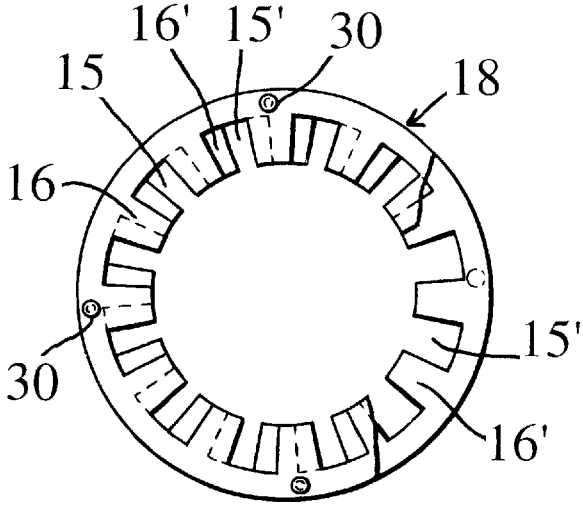
FIG. 4 shows a plan view of said teeth plate, with its recessed teeth and protrusive teeth shifted.
Figure 5:
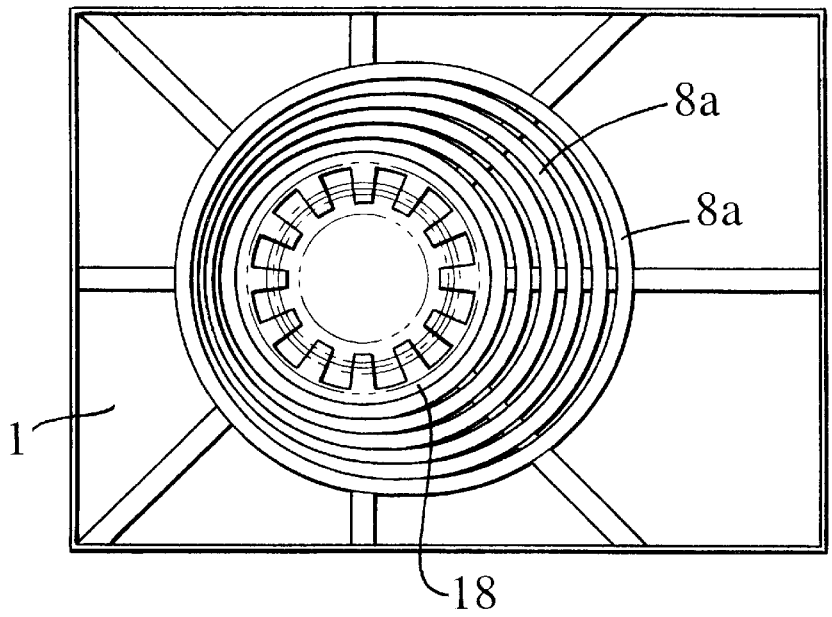
FIG. 5 shows a plan view of a crushing device according to another embodiment of the present invention.
Figure 6:
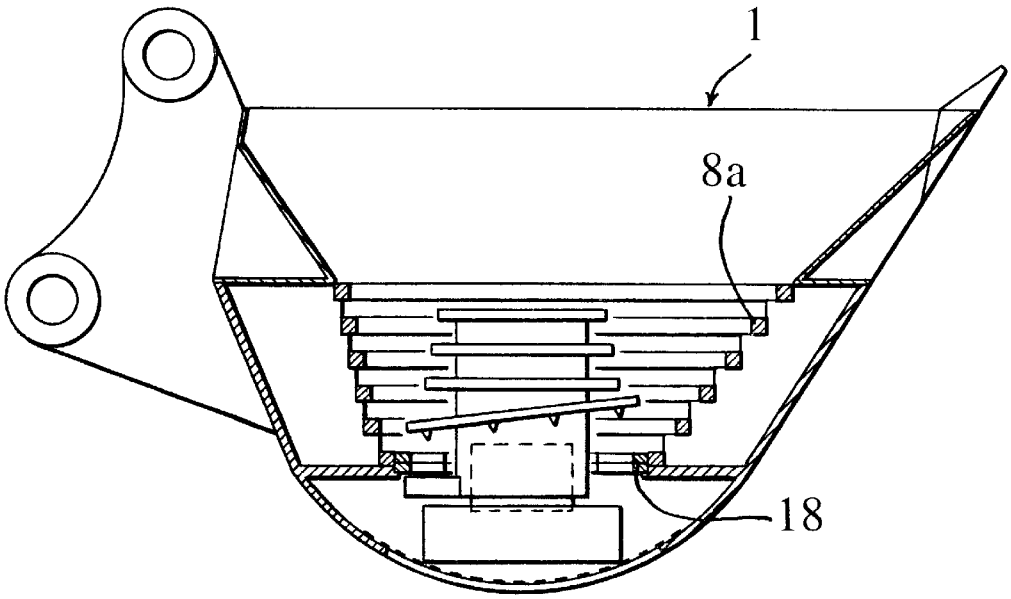
FIG. 6 shows a longitudinally cross-sectional view of the crushing device as shown in FIG. 5.

FIG. 5 shows another embodiment wherein elliptical ring members 8*a* are provided, without employing any ring member of perfect circle. The elliptical ring members 8 are provided in such a manner that they gradually increase the elliptic ratio from the lower position toward the upper position, thereby increasing the volume of the forward part of the body frame 1. This construction enables scooping much larger chunks of concrete than the construction using ring members of perfect circle. Referring to FIG. 4, recessed teeth 15 and protrusive teeth 16 of the teeth plate 18, which are in overlying relation with recessed teeth 15' and protrusive teeth 16' formed on a lower base of the body frame 1, can be shifted circumferentially and fixed by fixing bolts 30. In this manner, each width of the recessed teeth and the protrusive teeth 16 can be adjusted freely.

In FIG. 2, reference numeral 21 denotes a mesh plate blocking the bottom of the body frame 1. Fine pieces of concrete fall through the mesh plate 21 and accumulate on the ground. The mesh plate 21 is detachably mounted at the bottom of the body frame 1 so as to be detached when the crushing operation is performed without using it.

As seen from the above, the present invention has made it possible to freely select the degree of the size of pieces into which chunks of concrete are to be crushed, and also to obtain very fine pieces of concrete. The finer the pieces of crushed concrete become, the greater the scattering efficiency becomes.

What is claimed is:

1. A crushing device in a crusher for crushing objects into fine pieces, the crushing device comprising:

a bucket-shaped body frame;

plural ring members provided in said body frame in a horizontal orientation and forming steps at predetermined spaced intervals while gradually diminishing in size from an upper position toward a lower position of the body frame, thereby to form a sieve with gaps;

a teeth plate provided at the bottom portion of said sieve, said teeth plate having recessed teeth and protrusive teeth alternately formed on an inner surface thereof;

a crushing shaft provided at a central portion of said body frame; and an inclined screw belt member mounted on said crushing shaft for crushing pieces of objects in combination with said teeth plate.

2. The crushing device in a crusher for crushing objects into fine pieces, as claimed in claim 1, wherein said inclined screw belt has, on a lower surface, plural protuberances for impacting against said teeth plate.

3. The crushing device in a crusher for crushing objects into fine pieces, as claimed in claim 1, wherein a reinforced-concrete cutting member is fixed on said crushing shaft, said reinforced-concrete cutting member is located between said teeth plate and a motor rest mounted at a bottom portion of said body frame.

4. The crushing device in a crusher for crushing objects into fine pieces, as claimed in claim 1, wherein said ring members are of elliptic shape, a region of said ring members extending from around said crushing shaft toward one end of said body frame provides a scooping portion for large chunks of concrete.

5. The crushing device in a crusher for crushing objects into fine pieces, as claimed in claim 2, wherein said ring members are of elliptic shape, a region of said ring members extending from around said crushing shaft toward one end of said body frame provides a scooping portion for large chunks of concrete.

6. The crushing device in a crusher for crushing objects into fine pieces, as claimed in claim 3, wherein said ring members are of elliptic shape, a region of said ring members extending from around said crushing shaft toward one end of said body frame provides a scooping portion for large chunks of concrete.

7. The crushing device in a crusher for crushing objects into fine pieces, as claimed in claim 1, wherein a mesh plate is detachably mounted on said body frame to block a bottom space of said body frame and allow only fine pieces of concrete to fall through said mesh plate.

8. The crushing device in a crusher for crushing objects into fine pieces, as claimed in claim 1, wherein a width of each of the recessed teeth and the protrusive teeth is adjusted by shifting said teeth plate circumferentially.

* * * * *